US006752221B1

(12) United States Patent
Morissette

(10) Patent No.: US 6,752,221 B1
(45) Date of Patent: Jun. 22, 2004

(54) SELF-SUPPORTING PNEUMATIC HAMMER POSITIONER WITH UNIVERSAL JOINT

(76) Inventor: Danny Morissette, 283, Montée Sanche, Boisbriand (Québec) (CA), J7G 2E2

( * ) Notice: Subject to any disclaimer, the term of this patent is extended or adjusted under 35 U.S.C. 154(b) by 0 days.

(21) Appl. No.: 10/337,701

(22) Filed: Dec. 23, 2002

(51) Int. Cl.[7] ..... E21B 15/04

(52) U.S. Cl. ..... 173/38; 173/31; 173/32; 173/36; 173/193

(58) Field of Search ..... 173/38, 42, 44, 173/45, 192, 31, 32, 36, 193; 248/663, 651, 654

(56) References Cited

U.S. PATENT DOCUMENTS

| | | | | |
|---|---|---|---|---|
| 715,277 A | | 12/1902 | Leavitt | |
| 986,160 A | | 3/1911 | French | |
| 2,168,905 A | | 8/1939 | Lear | |
| 2,389,553 A | * | 11/1945 | Sellars | 248/662 |
| 2,528,362 A | | 8/1950 | Neyman | |
| 2,872,835 A | | 2/1959 | Talkington | |
| 3,203,489 A | * | 8/1965 | Fuehrer | 173/36 |
| 3,481,409 A | * | 12/1969 | Westerlund | 173/193 |
| 3,721,304 A | * | 3/1973 | Hanson | 173/2 |
| 3,872,933 A | | 3/1975 | Anderson et al. | |
| 4,234,155 A | * | 11/1980 | Destree | 248/651 |
| 4,251,046 A | * | 2/1981 | Walmsley et al. | 248/660 |
| 4,364,540 A | * | 12/1982 | Montabert | 248/654 |
| 4,410,049 A | * | 10/1983 | Molin | 173/2 |
| 5,107,933 A | * | 4/1992 | Wuhrer | 173/1 |

* cited by examiner

*Primary Examiner*—Scott A. Smith
*Assistant Examiner*—Chukwurah Nathaniel
(74) *Attorney, Agent, or Firm*—Francois Martineau

(57) ABSTRACT

A self-supporting pneumatic hammer positioner for effortless command and control by an operator of a pneumatic hammer. The positioner comprises a rigid elongated template having a handle at a first end portion thereof, a saddle mount for a pneumatic hammer at a second end portion thereof, and a 3-axes pivotal mount integral to an intermediate section of the elongated template. An articulated boom member is provided, having an inner end portion and an outer end portion, its inner end portion pivotally mounted to the 3-axes pivotal mount. The boom member outer end portion is pivotally mounted about a one-axis mount to a ground anchor base.

16 Claims, 10 Drawing Sheets

SELF-SUPPORTING PNEUMATIC HAMMER POSITIONER WITH UNIVERSAL JOINT

FIELD OF THE INVENTION

This invention relates to a suspending device for hand-held power hammers.

BACKGROUND OF THE INVENTION

In the construction industry, it is often necessary to make repairs to hard surface walls that are spaced over ground beyond arm's length. For example, maintenance repairs are periodically required on the superstructure of a motor vehicle highway overpass. This means that workers need to work from beneath, looking upwardly. Since some partial demolition of structure is required before repairs can be implemented, hand held power hammers form part of the required tools in this regard. Power hammers break concrete and other hard surfaces by the reciprocating motion of a hard tip tool. These power hammers are quite heavy, and can produce adverse medical conditions for the workers, induced by the hammer weight and vibrations produced by the operating hammer, for example the well known muscular tendinitis.

It is believed that there is a need for improvement and enhancement in the capabilities of existing suspending devices for hand held power hammers.

OBJECT OF THE INVENTION

The main object of the present invention is to improve upon suspending devices for hand-held power hammers, which makes it possible for the operator to command and control a hand-held power hammer without having to carry the weight of the hammer.

Another object of the invention is to provide a system to counteract the moment of force generated by a power hammer striking a work surface.

A further object of this invention is to improve upon productivity of power hammer operations.

SUMMARY OF THE INVENTION

In accordance with the object of the invention, there is disclosed a pneumatic hammer support member for mounting to a ground spaced end portion of an articulated boom, said support member having an elongated rigid frame, mounting means mounted at an intermediate section of said elongated rigid frame for relative 3-axes movement of said support member relative to the articulated boom, a saddle system for releasable attachment of a pneumatic hammer to an outer end portion of said rigid frame, and a handle member integrally mounted to an inner end portion of said rigid frame opposite said outer end portion thereof, said handle member for hand grasping by an operator; wherein the operator is able to manoeuver said support member in a loadless fashion.

Preferably, said mounting means could include a hemispheric socket, a spherical ball bearing rotatably mounted into said socket, a connector integral with said socket for operative connection with the articulated boom, a shaft having an intermediate portion extending through said ball bearing, and opposite bracket members anchored to said support member rigid frame and rotatively engaged by opposite ends of said shaft. Said socket and said ball bearing could form part of a self-alignment bushing assembly.

The invention also relates to the combination of an articulated boom having a pair of first and second arms pivoted to one another about a one-axis boom inter-arm pivot mount, said first pivotal arm having an inner end fixedly mounted by a boom anchor mount to an anchor base, said second pivotal arm having an outer end, and a pneumatic hammer support member mounted to said outer end of said articulated boom second arm, said support member having an elongated rigid frame, mounting means mounted at an intermediate section of said elongated rigid frame for relative 3-axes movement of said support member relative to said articulated boom, a saddle system for releasable attachment of a pneumatic hammer to an outer end portion of said rigid frame, and a handle member integrally mounted to an inner end portion of said rigid frame opposite said outer end portion thereof, said handle member for hand grasping by an operator;wherein the operator is able to manoeuver said support member in a loadless fashion.

Preferably, said boom anchor mount includes means for relative one axis rotational movement of said boom first arm, and releasable lock means to counteract the moment of force generated by a power hammer striking a work surface.

The invention also relates to a self-supporting pneumatic hammer positioner for effortless command and control by an operator of a pneumatic hammer, said positioner comprising:—a rigid elongated template having a handle at a first end portion thereof, a saddle mount for a pneumatic hammer at a second end portion thereof opposite said first end portion thereof, and a 3-axes pivotal mount integral to an intermediate section of said elongated template intermediate said first end portion and said second end portion thereof;—an articulated boom member having an inner end portion and an outer end portion, said inner end portion pivotally mounted to said 3-axes pivotal mount;—an anchor base, said boom member outer end portion pivotally mounted about a one-axis mount to said anchor base.

A lock member could then be releasably mounted to said anchor base to counteract the moment of force generated at said boom member outer end portion relative to said anchor base, when the generated hammer strikes a work surface.

Said saddle mount could include:—a carriage, slidingly mounted over said second end portion of said template;—guide means, guiding said carriage for travel between first and second limit positions;—ram means, for biasing said carriage to slide to an extended operative condition intermediate said first and second limit positions and—attachment members, anchored to said carriage for releasably anchoring the pneumatic hammer to said carriage. A self-alignment bushing assembly could form part of said 3-axes pivotal joint assembly.

Preferably, the hammer positioner could further include:—second ram means, for power assist pivotal displacement of said articulated boom member; and—third ram means, for power assist rotation of said template relative to said articulated boom member.

DETAILED DESCRIPTION OF THE PREFERRED EMBODIMENT

Figure 1:
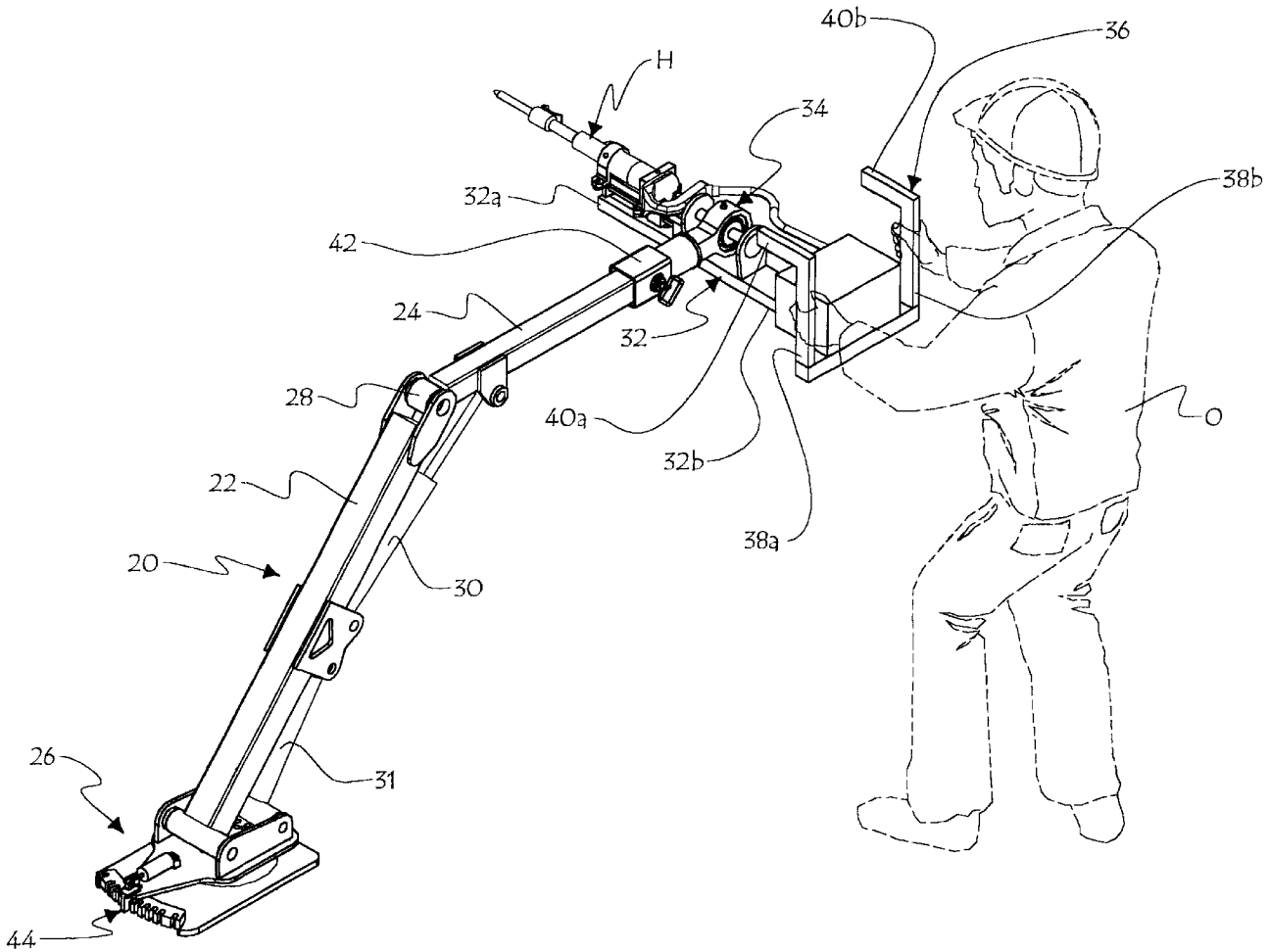
FIG. 1 is a perspective view of the pneumatic hammer power assist support device and associated ground standing articulated positioning arm, with an operator in phantom lines operating the pneumatic hammer in a horizontal direction.
Figure 2:
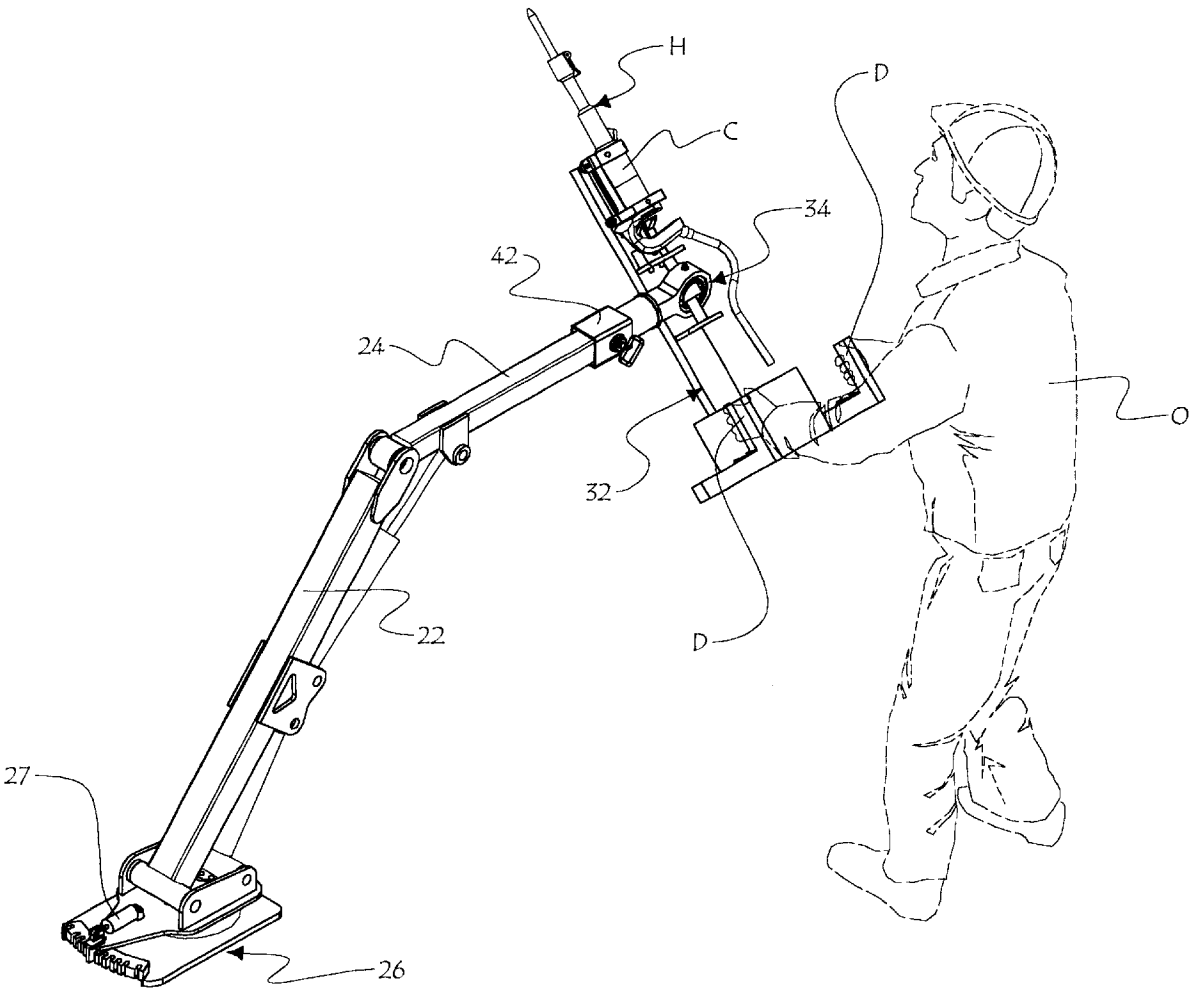
FIG. 2 is a view similar to FIG. 1, but with the pneumatic hammer being operated in an upwardly outwardly inclined direction.
Figure 3:
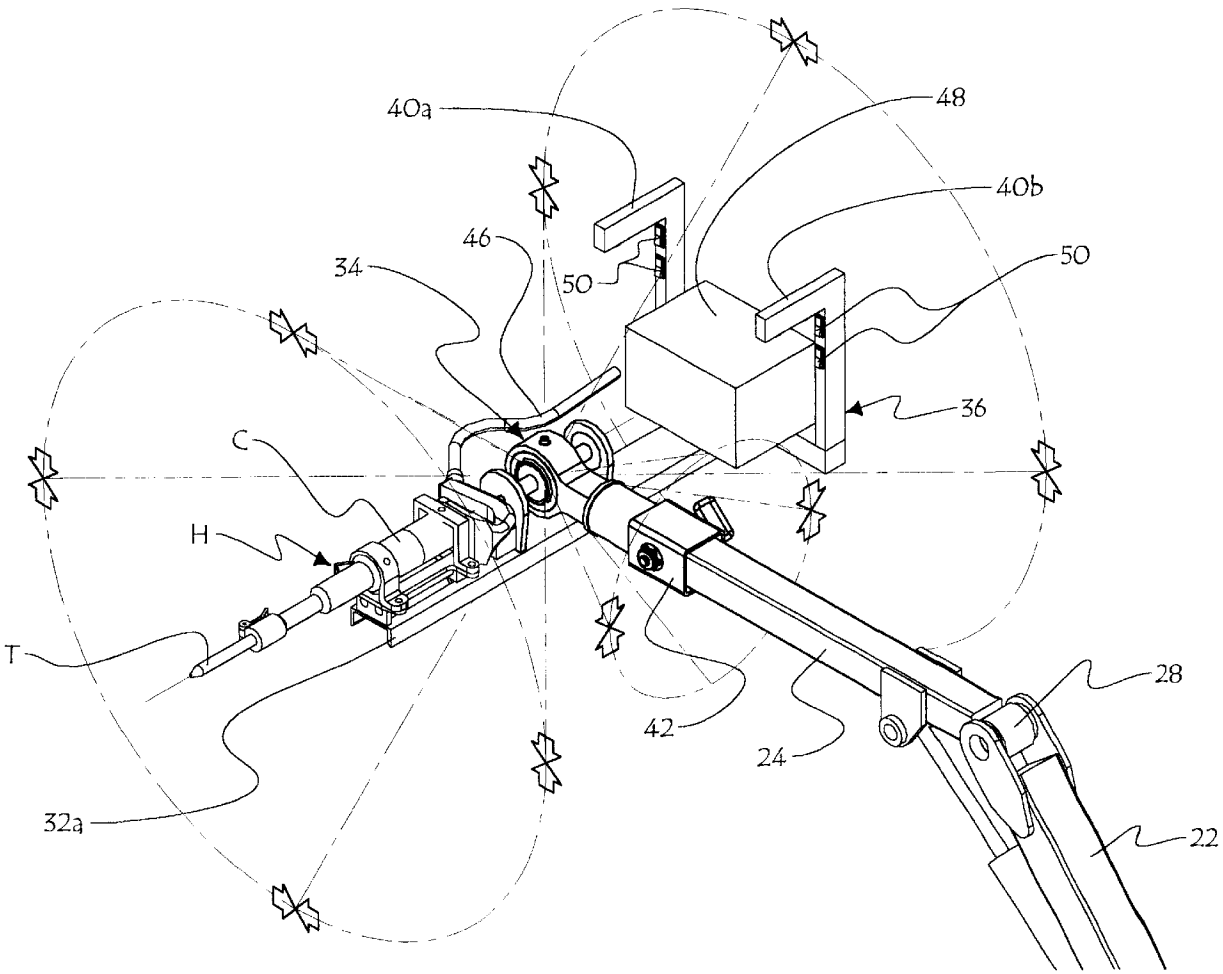
FIG. 3 is a schematic partial view of the present support device, suggesting the omni-directional play afforded by the universal joint forming part of the pneumatic hammer support device.

FIGS. 1–3 show how the present invention can be handled by an operator O. A positioning articulated boom 20, defining a lower arm 22 and an upper arm 24, is pivotally mounted by its lower arm 22 to the ground by a vertical one-axis pivotal foot mount 26. Lower arm 22 is also tiltable at its lower end portion, under power from ram 31 (detailed hereinbelow). Ram means 27, detailed later, releasably lock boom 20 against rotation relative to foot 26. Both arms 22 and 24 are pivoted to one another about a horizontal one-axis pivot mount 28. Ram means 30, 31, provide power assist to arms 22 and 24 respectively relative to ground foot mount 26. Ram means 30, 31, each includes an integral lock valve, to maintain the interconnected structures to their selected relative position. An elongated support 32 is further provided, having at an intermediate section thereof a three-axes universal joint assembly 34, and carrying at a fore end thereof 32A a pneumatic hammer H. The rear end 32B of elongated support 32, opposite fore end 32A, includes an integral U-shape handle 36. Preferably, each of the two side legs of U-shape handle 36 forms an integral L-shape as shown, defining upright legs 38A, 38B and two forwardly directed legs 40A, 40B.

The operator O may grasp with his hands D either the upright legs 38A, 38B, when working generally horizontally against a vertical wall surface with the hammer H as shown in FIG. 1, or the forward legs 40A, 40B, when working in an inclined fashion against a generally horizontal (or generally inclined) overlying wall surface with the hammer as shown in FIG. 2. Universal joint assembly 34 is connected to the outer end of the boom upper arm 24 by a connector 42 provided with a one axis axial rotational mount. With the analogy of a human arm (20), pivot 28 is the elbow and universal joint assembly 34, the wrist.

Figure 8:
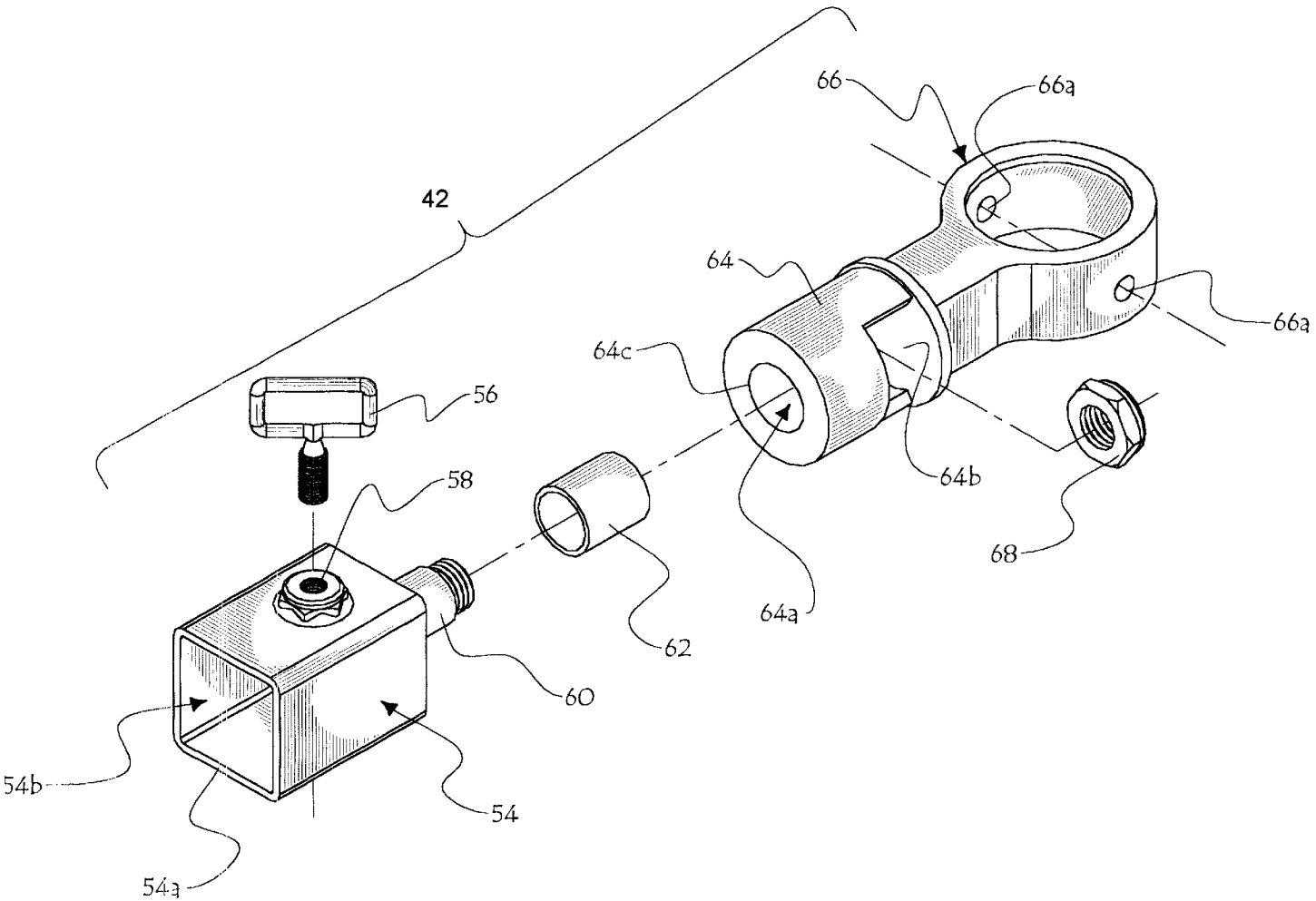
FIG. 8 is an exploded view of the pivotal joint assembly interconnecting the pneumatic hammer support device and the ground standing articulated positioning arm.

As shown in FIG. 8, connector 42 includes a socket 54, having a mouth 54A opening into a hollow 54B. Socket hollow 54B is complementarily shaped to the outer end portion of boom arm 24, for frictional engagement therein. A bolt 56 engages through a bore 58 in the wall of the socket 54, and through a corresponding bore (not shown) at an end portion of arm 24, and frictionally engages the registering section of boom arm 24 to keep it in place and to prevent accidental release therefrom. Socket 54 includes an axial projecting threaded shaft 60, freely engaged by a sleeve 62.

The hollow 64A of housing 64 receives the combined shaft 60 and surrounding sleeve 62. Housing 64 is anchored by welding to the casing 66 of corresponding ball and socket joint 34 by a nut 68, screwed in place into a connector recess 64B made in housing 64 opposite mouth 64C of hollow 64A. Accordingly, housing 64 and casing 66 can rotate together relative to the socket 54.

Figure 7:
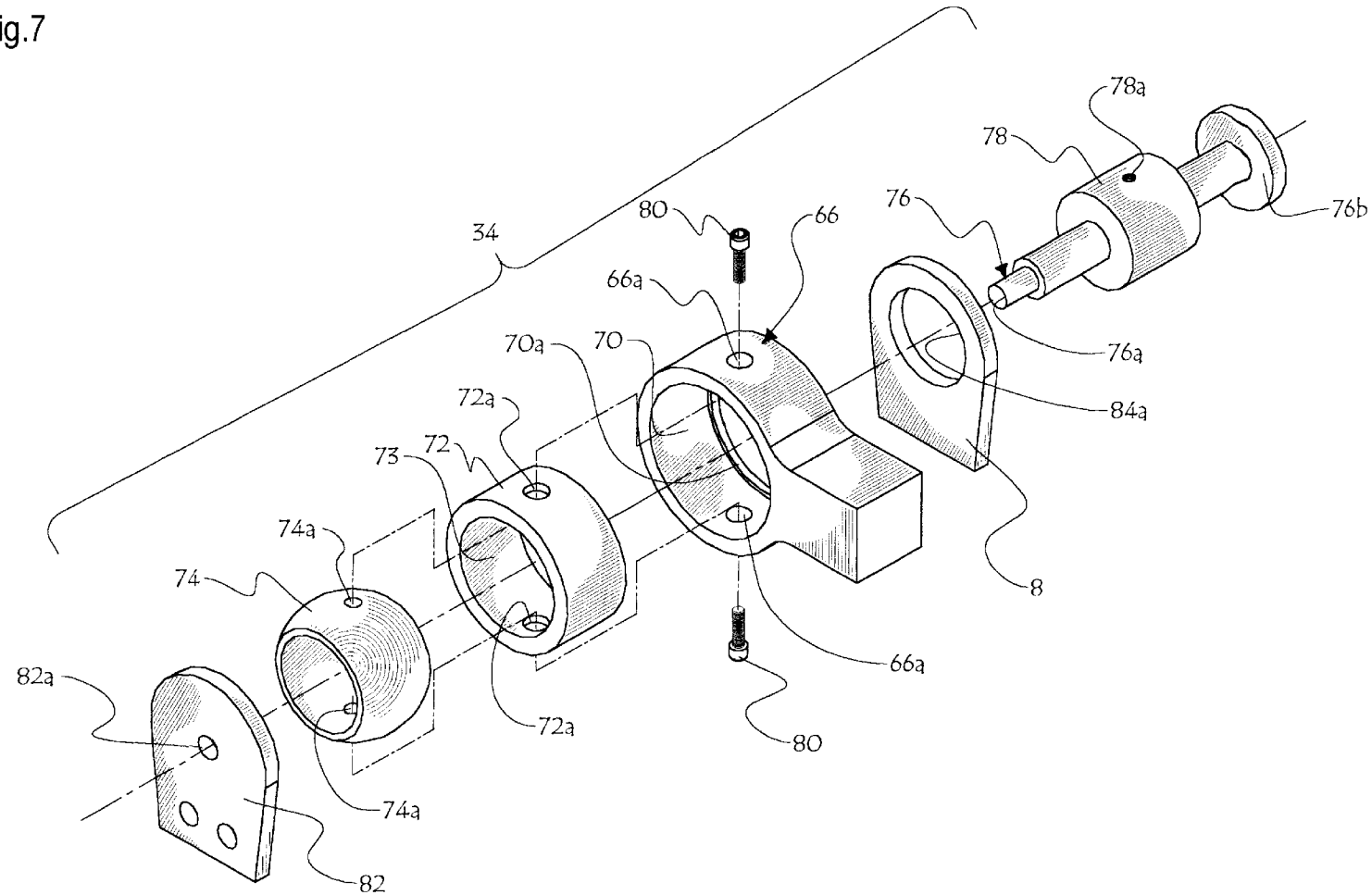
FIG. 7 is an exploded view at an enlarged scale of the universal joint assembly forming part of the pneumatic hammer support device.
Figure 9:
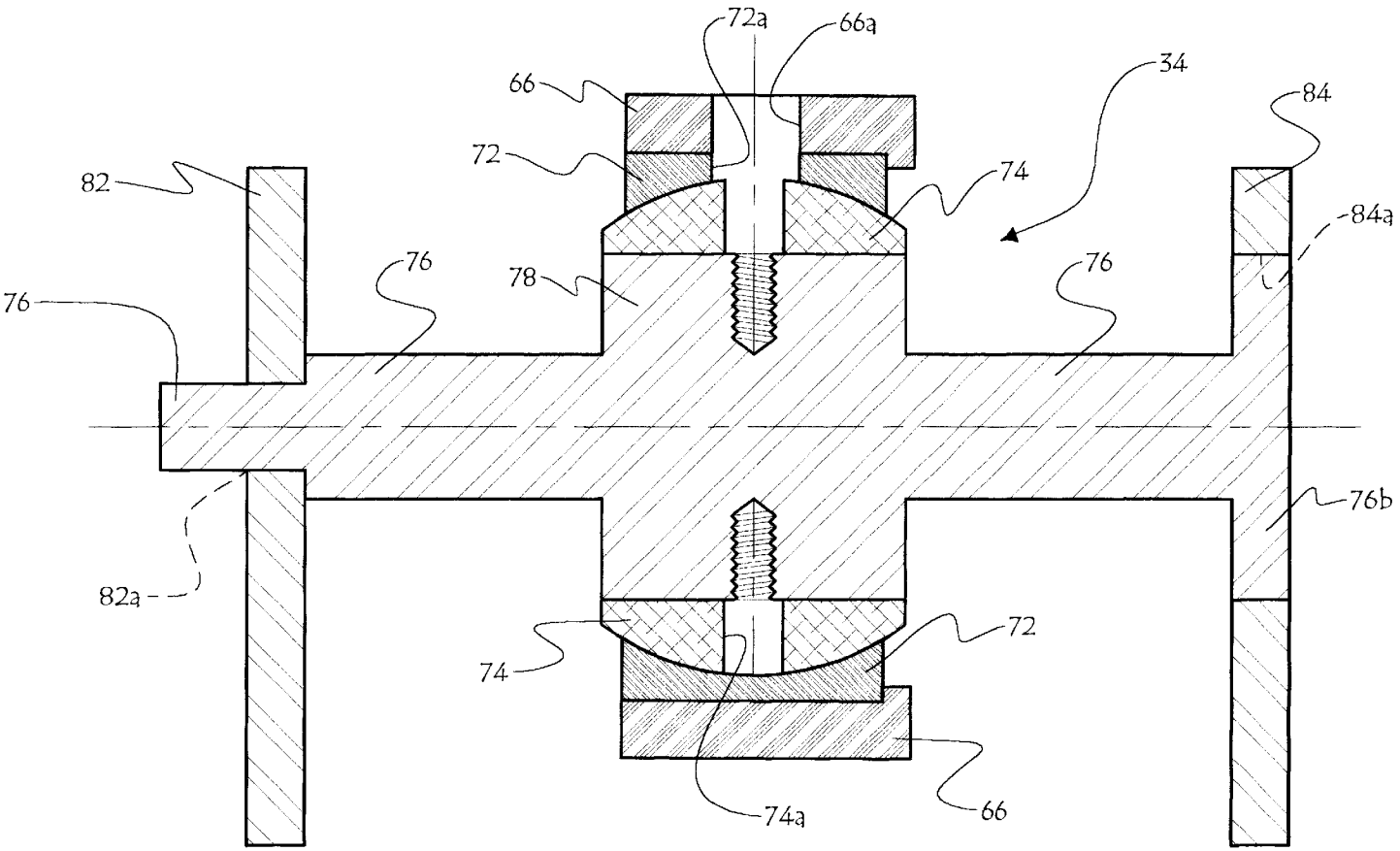
FIG. 9 is a cross-sectional view at an enlarged scale of the universal joint assembly of FIG. 6.

FIGS. 7 and 9 show the various components of the universal joint 34 of the present invention. The casing 66 includes a recessed aperture 70. A cylindrical collar 72 with a hemispheric hollow 73 receives therein a spherical ball 74. The ball 74 is mounted inside collar 72 for free rotation in all directions, but ball 74 is trapped inside hollow in that it cannot escape unless collar 72 is broken. Such an assembly of ball 74 rotatably trapped inside a socket 72 is called a "self-alignment bushing".

Collar 72 is complementarily shaped with recessed aperture 70, so that friction fit interlock occurs when collar 72 fully engages into housing 66. Recessed aperture 70 includes a radially smaller shoulder 70*a* at one edge thereof, against which snugly abuts collar 72. Collar 72 becomes trapped inside housing 66, and cannot move within the hollow 73 of housing 66, and so collar 72 and housing 66 become integral to one another.

A joint shaft 76 extends through joint components 66, 72, 74, with a radially enlarged intermediate section thereof 78 fitting snugly within the hollow of ball 74. A few socket cap screws 80, 80, interlock shaft enlarged portion 78 and ball 74, through threaded bore 78*a* and counter bore 74*a*, respectively, so that shaft 76 and 74 move integrally in unison. Enlarged access ports 72*a*, 66*a*, are provided on collar 72 and housing 66, respectively, to enable Allen key (or the like tool) access to the head of the cap screws 80 on shaft portion 78 and ball 74, whenever needed.

Attachment brackets 82, 84, are mounted on opposite sides of ball and socket joint assembly 66, 72, 74, 76. Bracket member 82 has a small bore 82*a* for free passage of joint shaft inner end portion 76*a*, while bracket member 84 has a large bore 84 to accommodate passage of enlarged portion 78 of joint shaft 76. The joint shaft outer end portion 76*b* forms a radially enlarged disk.

Joint components 66, 72, 74, 76 are therefore all carried by support bar 32.

The size of shaft 76–78, the distance between the two attachment brackets 82, 84, and the size of ball 74 determine the amplitude of movement in space of the hammer support 32.

Figure 4:
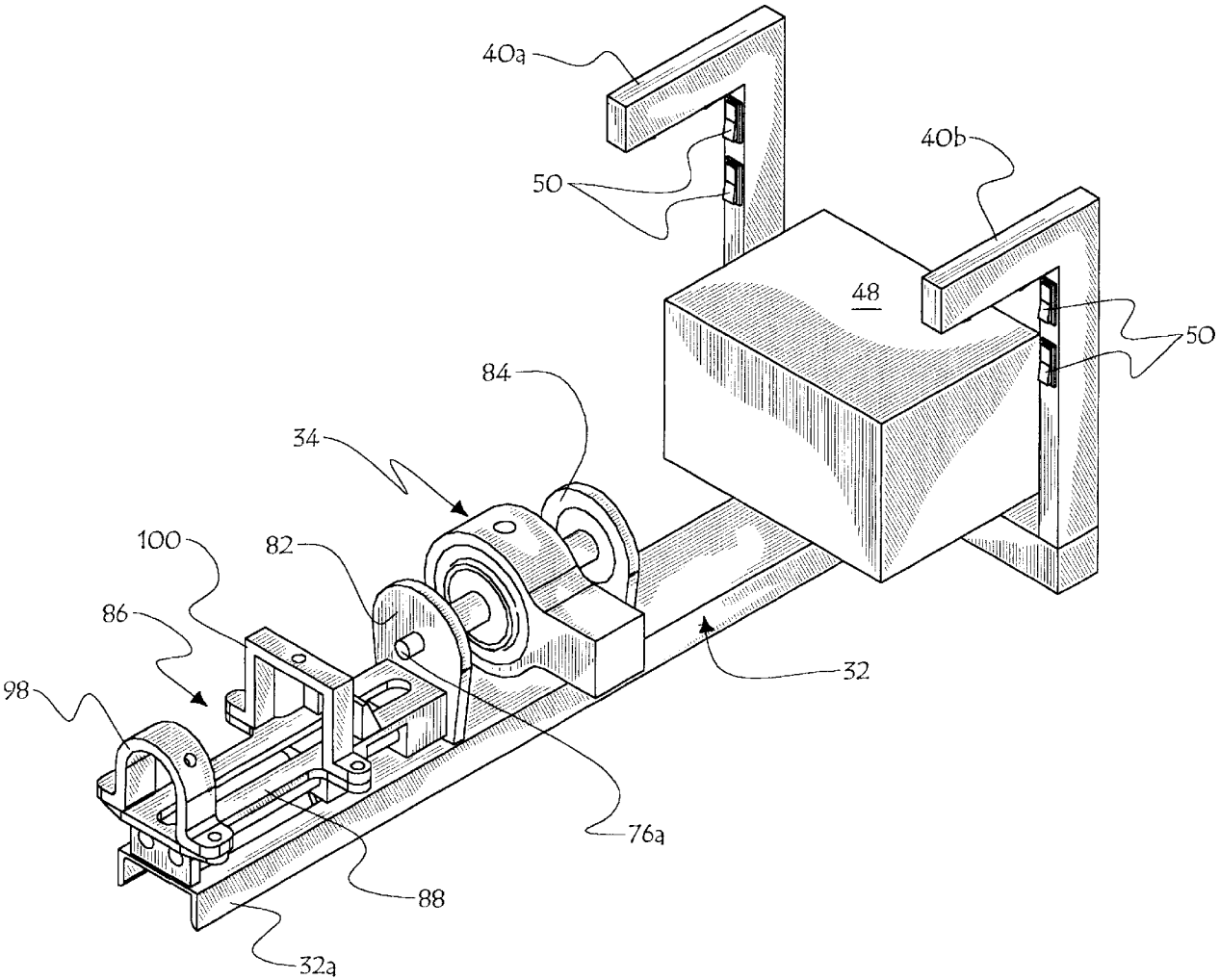
FIGS. 4 and 5 are perspective views at an enlarged scale of the pneumatic hammer support device, rotated by half a turn relative to one another.
Figure 5:
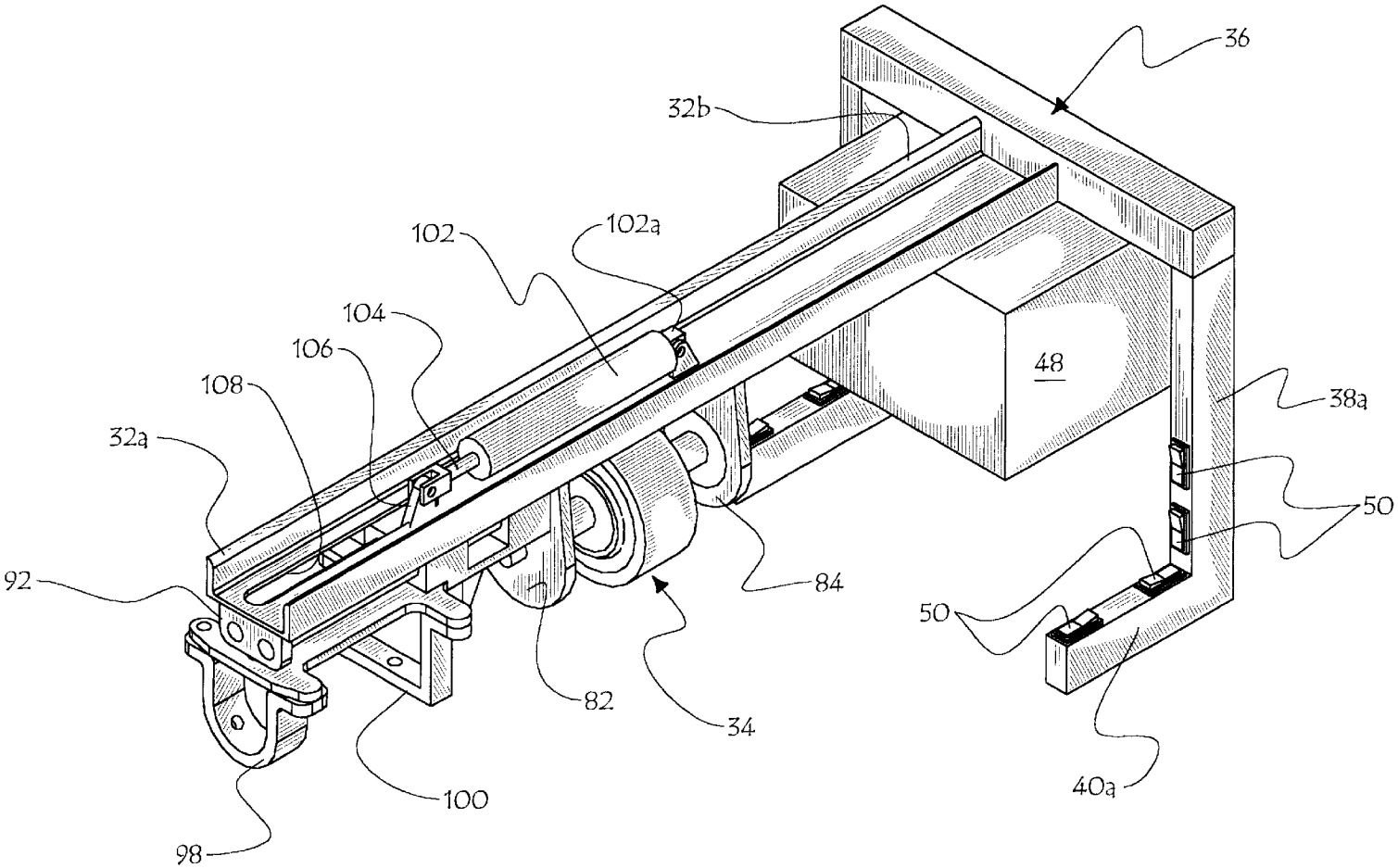
Figure 6:
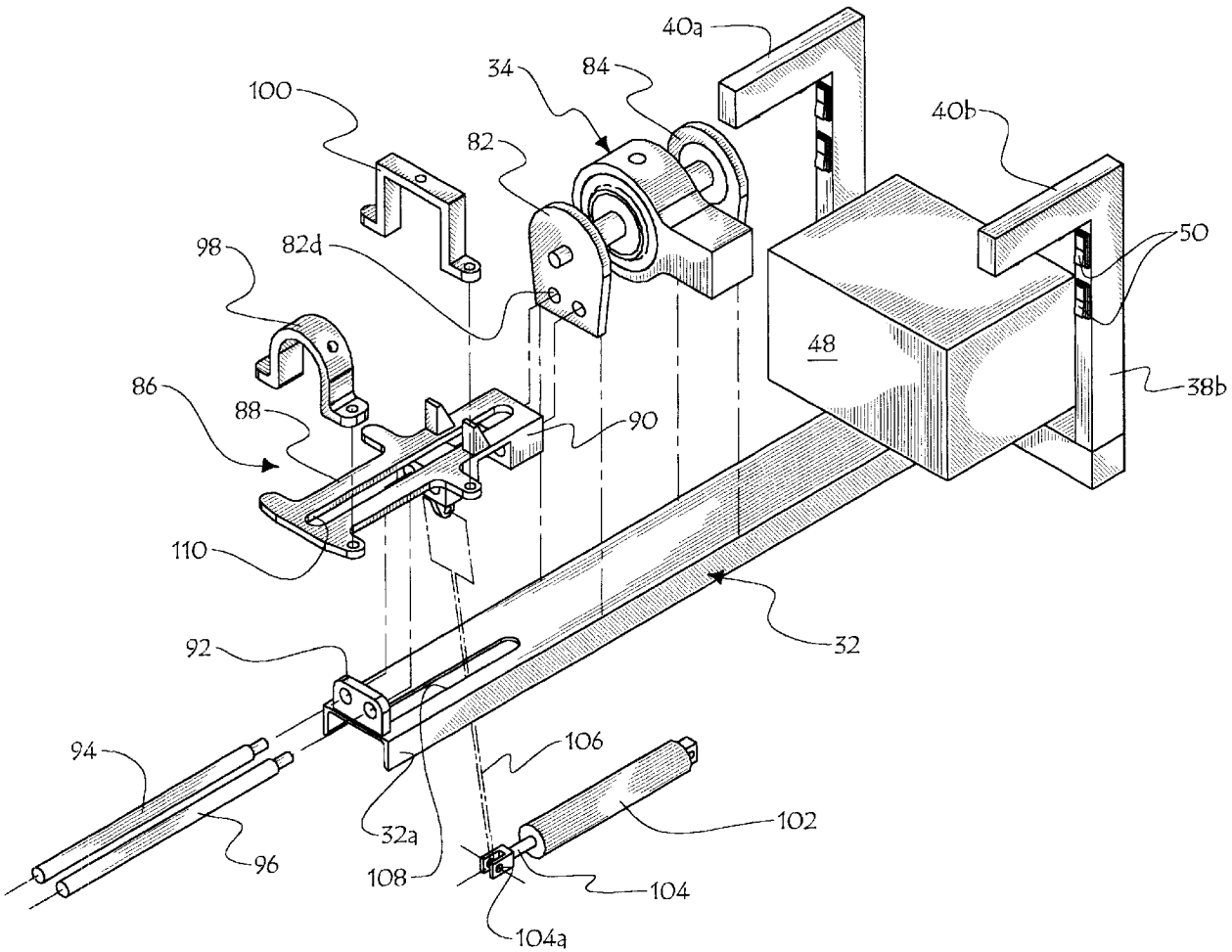
FIG. 6 is an exploded view of the upper portion of pneumatic hammer support device from FIG. 4.

FIGS. 4–6 show the saddle assembly 86 for attachment of the hammer H to the outer end portion 32A of support bar 32. Saddle assembly 86 includes a carriage 88, slidably mounted over bar end portion 32A. Carriage 88 includes a transverse downturned bored flange 90, at an inner end thereof, and bar 32 includes an upturned bar flange 92, wherein a pair of elongated guide rods 94, 96, engage at their opposite end portions flanges 90 and 92, respectively and a pair of additional bores 82D, 82D, respectively, of bracket 82. Guide rods 94, 96, guide displacement of carriage 88 slidingly parallel over end portion 32A and retain carriage 88 thereon. A pair of saddle members 98, 100, of a shape complementary to the main cylinder housing C of hammer H, fixedly anchor the latter to the respective opposite ends of sliding carriage 88. A pneumatic ram 102 is anchored at an inner end 102A to an intermediate portion of underface of template 32. A bracket 104A carried at the outer end of the piston rod 104 of ram 102, is transversely connected by a link arm 106 to hammer H, through ovoïdal slot 108 , made in registering portions of bar portion 32A and carriage 88, respectively.

Control box 48 shown for example in FIGS. 4–6, includes therein a first electropneumatic valve, which controls the ground base ram 27, a second electropneumatic valve, which controls the carriage displacement ram 102, a pneumatic valve which feeds pressurized air fluid to the operating hammer H, a time delay circuit, a pressure regulator for carriage ram 102 to adjust the push bias of the hammer H against the work surface, and a support electrical circuitry. This suppot electrical circuitry is in turn connected to hydraulic valves (not shown) which are located at the lower end of boom 22, and these latter valves feed in turn rams 30 and 31. Alternately, the control unit 48 could be done without and each hydraulic ram could be independently actuated manually, in a non electrical fashion, for example with a dedicated mechanical joystick.

Figure 10:
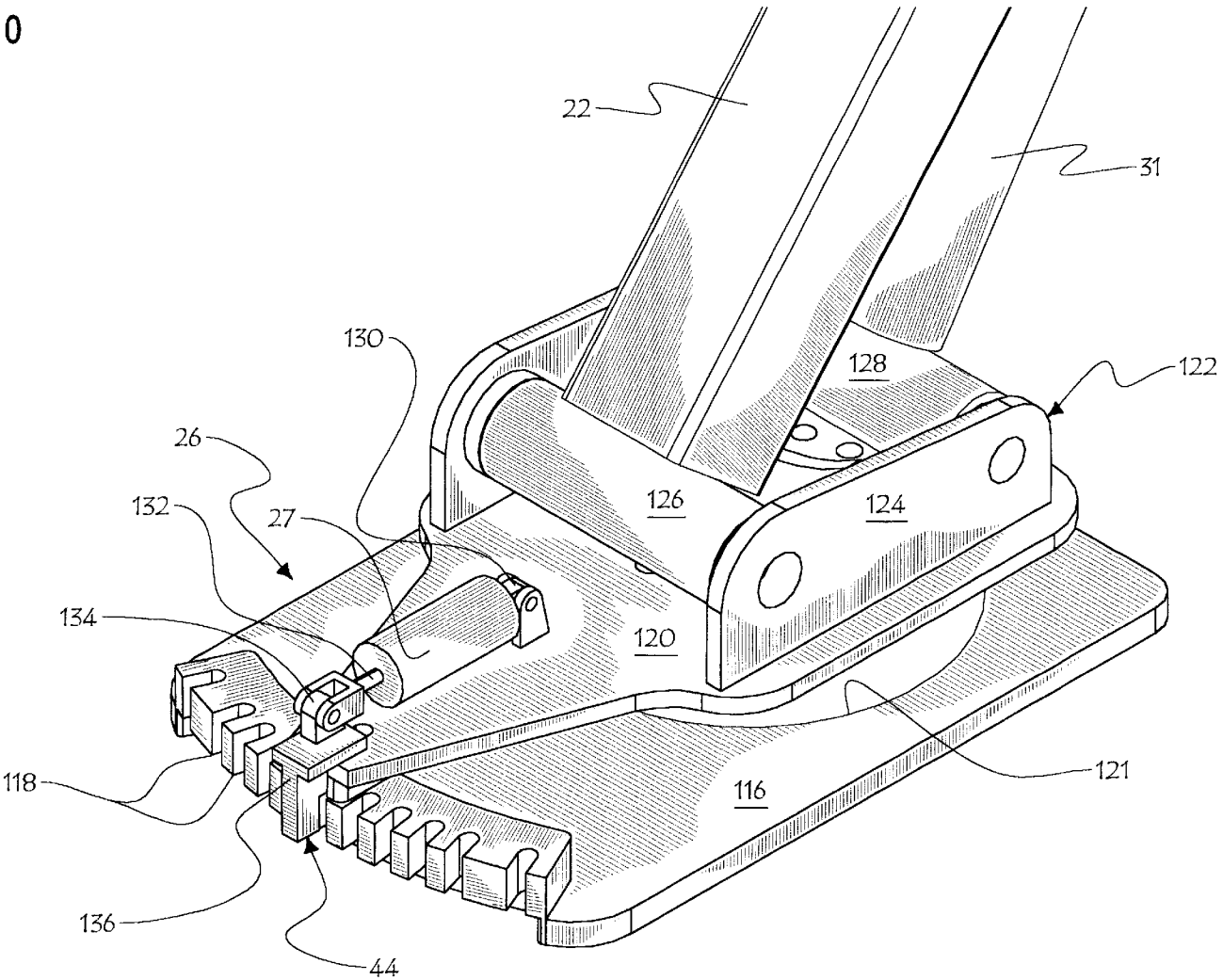
FIG. 10 is an enlarged perspective view of the ground foot member from the articulated positioning arm.

Foot 26, best illustrated in FIG. 10, includes a ground engaging plate 116 having a number of notches 118 along an edge portion thereof. A swivel pad 120 with turntable bearings 121 is pivotally mounted flatly against ground plate 116, for pivotal motion about a vertical axis. A pivotal assembly 122 is anchored to swivel pad 120. Pivotal assembly 122 includes a frame 124 having two parallel pivot axles 126, 128, extending orthogonally to the vertical pivot axis of swivel pad 120. The lower end of boom arm 22 is anchored to pivot axle 126, and the lower end of ram 31 is anchored to pivot axle 128. Ram 127 is anchored at its cylinder end to a pivotal bracket 130, anchored to swivel pad, with the axis of pivot mount 130 parallel to pivot axles 126 and 128. The outer end of the piston rod 132 of ram 27 carries a pivotal bracket 134, to which is anchored an indexing finger 136. Finger 136 is adapted to selectively register with one of the notches 118 of ground plate, when piston rod 132 is extended from ram 27, once piston rod 132 is retracted into ram 27. The air pressurisation constantly biases piston rod 132 to a selected lock position inside a notch 118, to counteract the moment of force generated by the power hammer H when striking a work surface.

As shown in FIGS. 2–3, the hammer tool T at the outer end of hammer H, extends generally parallel to support bar 32 and in a direction opposite operating handle 36. Tool T is adapted to conventionally strike a work surface, during operation. Pneumatic power is fed to the cylinder C, for sliding hammer H, including integral cylinder C, over support bar 32 backwardly, when not in use, or forwardly, when in use, via pneumatic line 46 connected to a pneumatic fluid source (not illustrated). Electrical control of all elements of the present invention is actuated via knobs 50 mounted to the legs of the handle 36. Knobs 50 control at least one of the following:

a) the energizing of the hammer tool T;

b) the sliding fore and aft displacement of the hammer H;

c) the 1-axis pivotal motion of upper boom arm 24 relative to lower boom arm 22;

d) the 1-axis pivotal motion of lower boom arm 22 relative to ground foot 26.

e) the control of cylinder 27 on base 120.

In operation, operator O first sends commands by knobs 50 to hydraulic rams 30 and 31 and to pneumatic cylinder 27, to pivot boom arms 22, 24 and rotate about ground pivot assembly 122, so as to bring the hammer H relatively close to the work surface area, in a coarse positioning fashion. Then, operator O manually pushes U-shape handle 36 to manoever support member 32 about joints 42 and 34, to provide further fine tuning in the orientation of the hammer H relative to the selected area of the work surface to be demolished. After that, operator O sends third commands by knobs 50 so that pneumatic ram 102 push piston rod 104 forward, to bring the hammer tool T in engaging contact with the work surface area . Only then is the hammer H energized to demolish the work surface. Ram 102 maintains its pressure on the hammer tool T so that the tool T remains constantly biased against the work surface, the work surface area becomes fragmented and progressively disintegrates. When hammering work is completed, the operator O sends a final command by knobs 50 to de-energize the hammer H and withdraw piston 104 into ram 102, i.e. to pull out hammer carriage 88 .

The present hammer support and positioner enables a worker to strike with the hammer tool at work surfaces which are vertical, horizontal or even inclined. Tools other than pneumatic hammers could interchangeably benefit from this self-supporting system, for example, an electric drill, a fluid hose, a firefighter water hose, or other heavy tools which must be handled by an operator with some precision required in targeting. Although mounting to a ground base 116 has been shown in the drawings, other types of mounting are not excluded. For example, one could pivotally mount joint 42 to a basket, (not shown) wherein arms 24, 22 and base 26 are therefore not needed and removed.

I claim:

1. A pneumatic hammer support member for mounting to a ground spaced end portion of an articulated boom, said support member having an elongated rigid frame, mounting means mounted at an intermediate section of said elongated rigid frame for relative 3-axes movement of said support member relative to the articulated boom, a saddle system for releasable attachment of a pneumatic hammer to an outer end portion of said rigid frame, and a handle member integrally mounted to an inner end portion of said rigid frame opposite said outer end portion thereof, said handle member for hand grasping by an operator;

wherein the operator is able to easily handle said support member.

2. A support member as in claim 1, wherein said mounting means includes a hemispheric socket, a spherical ball bearing rotatably mounted into said socket, a connector integral with said socket for operative connection with the articulated boom, a shaft having an intermediate portion extending through said ball bearing, and opposite bracket members anchored to said support member rigid frame and rotatably engaged by opposite ends of said shaft.

3. A pneumatic hammer support member as in claim 2, wherein said socket and said ball bearing form part of a self-alignment bushing assembly.

4. A pneumatic hammer support member as in claim 1, wherein said saddle system includes:

a carriage, slidingly mounted over said outer end portion of said rigid frame of said support member;

guide means, guiding said carriage for travel between first and second limit positions;

ram means, for biasing said carriage to slide to an extended operative conditions intermediate said first and second limit positions thereof; and attachment members, anchored to said carriage for releasably anchoring the pneumatic hammer to said carriage.

5. In combination, an articulated boom having a pair of first and second arms pivoted to one another about a one-axis boom inter-arm pivot mount, said first pivotal arm having an inner end fixedly mounted by a boom anchor mount to an anchor base, said second pivotal arm having an outer end, and a pneumatic hammer support member mounted to said outer end of said articulated boom second arm, said support member having an elongated rigid frame, mounting means mounted at an intermediate section of said elongated rigid frame for relative 3-axes movement of said support member relative to said articulated boom, a saddle system for releasable attachment of a pneumatic hammer to an outer end portion of said rigid frame, and a handle member integrally mounted to an inner end portion of said rigid frame opposite said outer end portion thereof, said handle member for hand grasping by an operator;

wherein the operator is able to easily handle said support member.

6. A combination as in claim 5, wherein said boom anchor mount includes means for relative one axis rotational movement of said boom first arm, and releasable lock means to counteract the moment of force generated by a power hammer striking a work surface.

7. A combination as in claim 5, wherein said mounting means includes a hemispheric socket, a spherical ball bearing rotatably mounted into said socket, a connector integral with said socket and operative connected with said articulated boom outer arm, a shaft having an intermediate portion extending through said ball bearing, and opposite bracket members anchored to said support member rigid frame and rotatively engaged by opposite ends of said shaft.

8. A combination as in claim 7, wherein said socket and said ball bearing form part of a self-alignment bushing assembly.

9. A combination as in claim 5, wherein said saddle system includes:

a carriage, slidingly mounted over said outer end portion of said rigid frame of said support member;

guide means, guiding said carriage for travel between first and second limit positions;

ram means, for biasing said carriage to slide to an extended operative conditions intermediate said first and second limit positions thereof; and attachment members, anchored to said carriage for releasably anchoring the pneumatic hammer to said carriage.

10. A self-supporting pneumatic hammer positioner for effortless command and control by an operator of a pneumatic hammer, said positioner comprising:

a rigid elongated template having a handle at a first end portion thereof, a saddle mount for a pneumatic hammer mounted to a second end portion of said template opposite said first end portion thereof;

a 3-axes pivotal joint assembly mounted integral to an intermediate section of said elongated template intermediate said first end portion and said second end portion thereof; and support means, supporting said pivotal joint assembly spacedly over ground.

11. A pneumatic hammer positioner as in claim 10, wherein said support means includes:

an articulated boom member having an inner end portion and an outer end portion, said inner end portion pivotally mounted to said 3-axes pivotal joint assembly; and an anchor base, said boom member outer end portion pivotally mounted about a one-axis mount to said anchor base.

12. A hammer positioner as in claim 11, further including a lock member, releasably engaging said anchor base to counteract the moment of force generated at said boom member outer end portion relative to said anchor base, when the pneumatic hammer strikes a work surface.

13. A hammer positioner as in claim 11, wherein said saddle mount includes:

a carriage, slidingly mounted over said second end portion of said template;

guide means, guiding said carriage for travel between first and second limit positions;

ram means, for biasing said carriage to slide to an extended operative condition intermediate said first and second limit positions thereof; and attachment members, anchored to said carriage for releasably anchoring the pneumatic hammer to said carriage.

14. A hammer positioner as in claim 13, further including:

second ram means, for power assist tilt displacement of said articulated boom member; and rotational means, for rotation of said template relative to said articulated boom member.

15. A hammer positioner as in claim 11, further including:

first ram means, for power assist pivotal displacement of said articulated boom member; and rotational means, for rotation of said template relative to said articulated boom member.

16. A hammer positioner as in claim 10, wherein a self-alignment bushing assembly forms part of said 3-axes pivotal joint assembly.

* * * * *